United States Patent [19]

Leiponen et al.

[11] Patent Number: 4,894,129

[45] Date of Patent: Jan. 16, 1990

[54] METHOD AND APPARATUS FOR POSITIONING SHEET-LIKE OBJECTS

[75] Inventors: Matti O. Leiponen; Kylä-Heikkilä Väinö I., both of Espoo, Finland

[73] Assignee: Outokumpu Oy, Helsinki, Finland

[21] Appl. No.: 146,236

[22] Filed: Jan. 20, 1988

[30] Foreign Application Priority Data

Jan. 22, 1987 [FI] Finland ..... 870285

[51] Int. Cl.[4] ..... C25D 17/06

[52] U.S. Cl. ..... 204/198; 204/225; 204/297 R

[58] Field of Search ..... 204/225, 297 R, 245, 204/198

[56] References Cited

U.S. PATENT DOCUMENTS

| | | | |
|---|---|---|---|
| 3,480,526 | 11/1969 | Duclaux | 204/297 R X |
| 4,028,211 | 6/1977 | Hirakawa et al. | 204/225 X |
| 4,326,937 | 4/1982 | Neumeier et al. | 204/225 X |
| 4,436,606 | 3/1984 | Viellefont et al. | 204/297 R |

FOREIGN PATENT DOCUMENTS

| | | |
|---|---|---|
| 3445830 | 6/1986 | Fed. Rep. of Germany . |
| 3508195 | 9/1986 | Fed. Rep. of Germany . |

*Primary Examiner*—Donald R. Valentine

*Attorney, Agent, or Firm*—Brooks Haidt Haffner & Delahunty

[57] ABSTRACT

The invention relates to a method and apparatus for positioning sheet-like objects, anodes and/or cathodes, in an electrolysis tank, when the positioning is carried out by utilizing a gripping device (2) designed for gripping sheet-like objects and connected to the loading member (1). According to the invention, the gripping device (2) is movable with respect to the loading member (1) and the electrolysis tank (5) so that the position of the gripping device (2) is adjusted essentially accurately with respect to the electrolysis tank (5) and the loading member (1), on the basis of the measurements carried out by the aid of the identification marks (7) placed in the electrolysis tank (5).

8 Claims, 2 Drawing Sheets

METHOD AND APPARATUS FOR POSITIONING SHEET-LIKE OBJECTS

Figure 1:
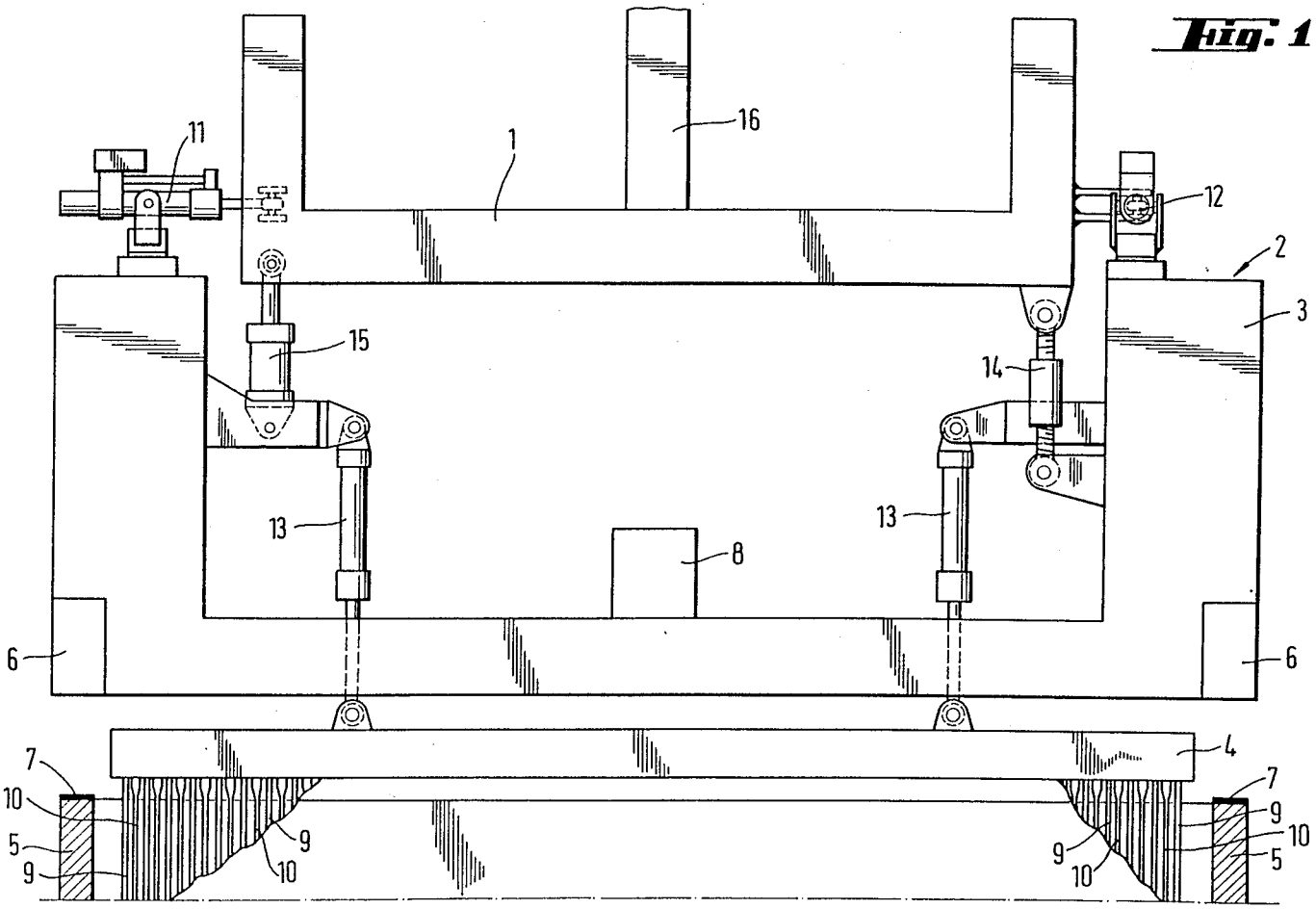

The present invention relates to a method and apparatus for positioning sheet-like objects, such as sheet-like electrodes used in electrolytic refining, essentially automatically to the treatment position.

Electrolytic refining processes employ large amounts of anodes and cathodes for precipitating and decomposing metals. These processes require the transfer of the sheet-like electrodes, the anodes and cathodes, for instance into electrolysis tanks and away therefrom. At present the transport and batching of electrodes into the tanks is carried out by means of a tool, i.e. a spear, hanging from the hooks of a bridge crane. The spear treats one tankful of a respective amount of anodes or cathodes at a time, although attempts have been made in favour of simultaneous treatment of both anodes and cathodes.

With the prior art technique, the lowering of electrodes into the tanks is troublesome and requires manual control of the spear at the tank level. The electrodes to be lowered into the tank may easily collide to those already existing there, because the electrode intervals are small and also irregular due to the manual working method. Collisions cause defects particularly in the starting sheets, which leads to an increase in short circuits during the electrolysis. Moreover, the manual treatment of separate electrode sheets in the tanks in order to position the sheets correctly is utterly ineffective.

In electrolytic refineries, the expenses can be cut remarkably by an essentially automatic treatment of the electrode sheets. The system of automated operation presupposes, however, an accurate positioning of the crane that lowers the electrodes into the tank. The stopping accuracy of ordinary cranes with microprocessor control is ±10–30 mm, which is not sufficient for an automated batching of the electrodes. If the level of accuracy is raised by improving the crane and track constructions, the resulting expenses will be very high.

Therefore the purpose of the present invention is to achieve a method and apparatus for positioning sheet-like objects so that some of the drawbacks of the prior art can be eliminated and the positioning of sheet-like objects can be carried out essentially accurately, the level of accuracy being advantageous for automated operation. The essential novel features of the invention are apparent from the appended patent claims.

When applying the invention to a conventional loading means, such as the bridge crane, the loading member of the crane is in the present invention provided with a gripping device, the position whereof is advantageously adjustable with respect to the loading position, such as the identification marks attached to the electrolysis tanks. Because the locations of the loading positions, especially in old installations, may be very irregular, the gripping device can be adjusted essentially freely on the horizontal level, both by turning around the vertical axis and by proceeding linearly in the transversal and longitudinal directions. Moreover, the variation of height of the trajectories of the loading member and the deflections of the housing, as well as possible inclinations of the tanks with respect to each other, require essentially slight adjustments and corrections of the inclination of the gripping device.

In order to define the position of the gripping device with respect to the loading position, the method of the present invention includes a measuring member placed at least at two corners of the gripping device housing, which measuring member advantageously identifies the marks attached on respective spots of the loading position on the basis of the shape of the said marks. The measuring member can advantageously be operated for instance optically, in which case an advantegeous shooting rate of the measuring member is at least 10–30 images per second. Identification can, however, also be carried out for example electronically or in some other corresponding fashion. In order to accurately define the position of the gripping device while the mark is partly covered, the measuring member can be made to define for instance the coordinates of the midpoint of the identified mark.

While applying the method of the present invention to the lowering of sheet-like electrodes, anodes and cathodes, down to the electrolysis tanks, it is important to minimize all possible measuring errors, because in the electrolysis tanks the electrodes, i.e. the anodes and the cathodes, are located very near to each other. In the identification of the marks placed in the tanks, there is advantageously employed computerized vision technique, whereby the coordinates of the mid-points of the identification marks can easily be calculated even if part of the marks is covered.

By employing the method and apparatus of the present invention, there is advantageously achieved a data processing rate of at least 10–30 images per second, as well as a measuring accuracy of ±0.5 mm, which is sufficient for instance when applying the invention to the lowering of sheet-like electrodes into the electrolysis tanks.

The expenses of the apparatus of the present invention are very small. The expenses are additionally reduced by the fact that while applying the invention, the existing loading member tracks, crane tracks and loading vessels such as electrolysis tanks, can be utilized—or respectively in new facilities, such accuracies that multiply the price of the equipment are not needed.

Figure 2:
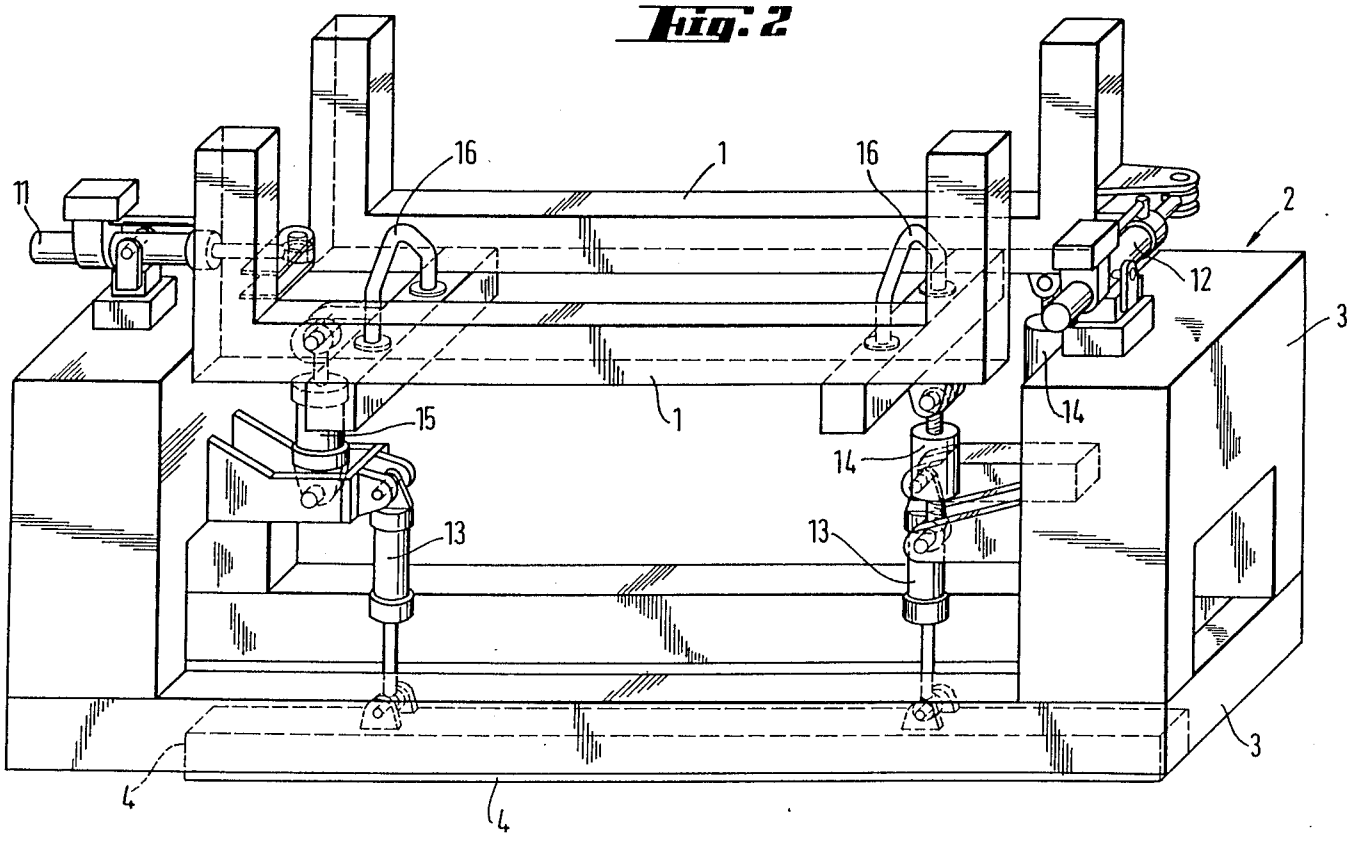

In the following the invention is explained in more detail with reference to the appended drawings, where FIG. 1 is a schematical side-view illustration of a preferred embodiment of the invention, and FIG. 2 is an axonometric illustration of another preferred embodiment of the present invention.

In FIG. 1, the loading member 1 of a bridge crane is provided, according to the invention, with a gripping device 2 suited for gripping sheet-like objects and to be used in electrolytic refineries, which gripping device advantageously comprises the housing 3 and the gripper 4. The gripping device 2 is provided with members for moving the device both with respect to the loading member 1 and to the electrolysis tanks 5 in order to advantageously position the gripping device. When the loading member 1 is brought, by means of the bridge crane, to the location of the desired electrolysis tank 5, the camera 6 installed in the housing 3 of the gripping device starts registering in order to detect the identification marks 7 attached to the tank 5. The number of the cameras 6 is advantageously at least two, and the number of the identification marks 7 is advantageously equal to that of the cameras. The information contained in the images registered by the cameras is transferred into the data processing unit 8, which advantageously defines the shape and location of the identification marks 7 and sends the necessary commands to the members 11, 12, 14 and 15 in order to shift the gripping device 2 to an advantageous position with respect to the electrolysis tank 5 in order to lower or raise the sheet-like anodes 9 and/or cathodes 10 from the tank 5.

In order to move the gripping device 2 in the longitudinal and transversal directions with respect to the loading member 1 and the electrolysis tank 5, the housing 3 of the device is provided with actuators 11 and 12, which are attached both to the housing 3 and to the loading member 1. By means of the forces generated by the members 11 and 12 either pneumatically, hydraulically or electrically, the gripping device 2 is made to move with respect to the loading member 1. If the actuators 11 and 12 are set to operate essentially simultaneously, the gripping device 2 will revolve with respect to the loading member 1. The resulting revolving motion is advantageously controlled by means of control members, i.e. turnbuckles 14, placed in between the loading member 1 and the housing 3. Thus the housing 3 and the gripper 4 of the gripping means can be advantageously moved on the horizontal level in different directions with respect to the loading member 1.

It is a generally known fact that electrolytic refineries usually contain several tens of electrolysis tanks 5, where sheet-like electrodes are treated. The location of these tanks 5 with respect to each other on the horizontal level may change, in which case the lowering or raising of the electrodes becomes more troublesome if the created deviation cannot be corrected by means of the gripping device. Similarly, any possible deflections occurring in the trajectories of the loading member 1 lead to a situation where the position of the gripping device 2 with respect to the electrolysis tanks 5 deviates from the horizontal level. Therefore the apparatus of the invention is provided with an inclination control member 15, installed in between the loading member 1 and the housing 3 of the gripping device, which control member 15 is used for correcting the deviation, owing to the inclination of the tanks 5 with respect to each other.

The gripper 4 of the gripping means of the present invention is, according to FIG. 1, suspended by means of the control members 13 so that the whole of the gripper 4 is located underneath the housing 3, but—as is apparent from FIG. 2—the gripper 4 may, by the aid of the control members 13, also be suspended so that the gripper 4 is advantageously on an essentially same level with the housing 3. In addition to this, the gripper 4 is provided with members for gripping the sheet-like electrodes while raising the electrodes up from the tank 5 or while lowering them down into the tank 5, as well as with members 16 for fastening the loading member 1 to the conveying lift and transport means.

We claim:

1. A method for positioning sheet-like objects, anodes and/or cathodes, in an electrolysis tank when the positioning is carried out by utilizing a gripping device connected to a loading member, wherein the gripping device can be moved with respect to the loading member and the electrolysis tank so that the position of the gripping device is adjusted essentially accurately with respect to the electrolysis tank and the loading member, on the basis of the measurements carried out by the aid of identification marks located in the electrolysis tank including making use of measurements of the shape and position of said identification marks in order to adjust the position of the gripping device.

2. The method of claim 1 wherein in order to adjust the position of the gripping device measurement of the horizontality of the gripping device is made use of.

3. The method of claim 1 or 2, wherein measurement is carried out optically.

4. The method of claim 3, comprising using a measuring rate of at least 10–30 images per second.

5. An apparatus for positioning sheet-like objects, anodes and/or eathodes, in an electrolysis tank when the positioning is carried out by utilizing a gripping device connected to a loading member wherein the gripping device is provided with members for moving the apparatus with respect to the loading member and the electrolysis tank, as well as with at least two measuring members for defining the position of the gripping device.

6. The apparatus of claim 5, wherein the number of the measuring members installed in the gripping device is equal to the number of the identification marks placed in the electrolysis tank.

7. The apparatus of claim 5 or 6, wherein the gripping device is movable on the horizontal level with respect to the loading member and the electrolysis tank.

8. The apparatus of claim 5, or 6 wherein the gripping device is movable according to the inclination of the electrolysis tank.

* * * * *